United States Patent [19]

Block

[11] Patent Number: 4,516,279

[45] Date of Patent: May 14, 1985

[54] UNIVERSAL CHILD'S TOILET TRAINER

[76] Inventor: Richard M. Block, 1340 Custer Ave., Cincinnati, Ohio 45202

[21] Appl. No.: 552,009

[22] Filed: Nov. 15, 1983

Related U.S. Application Data

[63] Continuation-in-part of Ser. No. 373,239, Apr. 29, 1982, abandoned.

[51] Int. Cl.[3] ..... A47K 13/00

[52] U.S. Cl. ..... 4/235; 4/239; 4/236; 4/240

[58] Field of Search ..... 4/234, 235, 237, 239, 4/483; D23/53, 71; 297/1, 3, 118, 232, 234, 257, 252, 283, 250

[56] References Cited

U.S. PATENT DOCUMENTS

| | | | |
|---|---|---|---|
| 799,935 | 9/1905 | Parker | 4/239 |
| 1,015,512 | 1/1912 | Ross et al. | 4/234 |
| 1,196,427 | 8/1916 | Brandenburg | 4/235 |
| 1,701,115 | 2/1929 | McKinney | 4/235 |
| 2,047,480 | 7/1936 | MacDonald | 4/235 |
| 2,111,044 | 3/1938 | Crosby | 4/234 |
| 2,155,577 | 4/1939 | Zaio | 4/235 |
| 2,494,813 | 1/1950 | Hughes | 4/235 |
| 2,544,792 | 3/1951 | Jack | 4/239 |
| 2,584,141 | 8/1948 | Liebling | 4/234 |
| 2,692,992 | 11/1954 | Thimmes et al. | 4/235 |
| 2,693,602 | 11/1954 | Meath | 4/235 |
| 2,808,874 | 10/1957 | Liebling | 4/239 |
| 2,820,969 | 1/1958 | Wedge | 4/239 |
| 2,880,786 | 4/1959 | Black | 297/381 |
| 3,153,248 | 10/1964 | Miller | 4/239 |
| 3,371,356 | 3/1968 | Benjamin | 4/239 |
| 3,601,822 | 8/1971 | Weiss | 4/234 |
| 4,461,046 | 7/1984 | Adams | 4/239 X |

*Primary Examiner*—Henry K. Artis
*Attorney, Agent, or Firm*—Frost & Jacobs

[57] ABSTRACT

A universal child's toilet trainer adaptable and usable with the conventional commode provides an auxiliary toilet seat which in a use position lies on top of the conventional toilet seat and which in a storage position rests against the lid of the commode. The child's toilet trainer comprises an auxiliary toilet seat, a pair of extension arms attaching the auxiliary toilet seat to the conventional toilet lid, and a pick-up unit attached to the conventional lid for moving the auxiliary toilet seat between an operational position and a storage position. The pick-up unit has a strip with a pair of projections secured to the lid. A cut-out on each extension arm fits onto a projection. A hook on the strip engages an opening in the auxiliary seat so as to raise the auxiliary seat to the storage position from the operational position. Alternatively, the auxiliary toilet seat is connected to the commode and a protrusion on the underside of the conventional lid engages the opening in the auxiliary seat.

13 Claims, 9 Drawing Figures

3
15
35
9
17
5
16
32
33
28
45
34
4
31

4
5
40
41
35
37
36
15
39
11
26
27
17
30
5
16
19
28
3
9
3

UNIVERSAL CHILD'S TOILET TRAINER

This application is a continuation-in-part of application Ser. No. 373,239, filed 4-29-82, abandoned.

TECHNICAL FIELD OF THE INVENTION

The present invention relates to toilet seats, and more particularly, to a child's toilet trainer to be used with a conventional toilet seat and lid.

DESCRIPTION OF THE BACKGROUND ART

Infants and children encounter numerous difficulties in using conventional toilet seats which are of a size to accommodate adult users. Infants and children using conventional toilet seats often fear falling into the commode and risk injury due to the failure of adult toilet seats to accommodate them comfortably. As is known in the art, various types of children's toilet seats and toilet trainers have been developed to provide the infant or child with his own toilet seat having smaller dimensions than that of the adult toilet seat. However, while meeting the problems of providing a smaller toilet seat, these prior toilet trainers create various sanitary, aesthetic, and accessibility problems.

Numerous requirements are desired in a child's toilet seat or toilet trainer. A child's toilet seat should require minimal handling by adults who wish to use the conventional toilet seat after the child. The child's toilet trainer should be usable with the conventional toilet bowl to eliminate the need of an adult handling, emptying and cleaning the toilet trainer after each use by the child. Since children often require frequent use of the toilet trainer, the child's toilet seat should be capable of remaining affixed to the conventional commode so as to always be ready to use. However, when the child's toilet seat is not being used, it should neither restrict the use of the commode by an adult nor provide an unsightly, unaesthetic view while the child's toilet seat is stored in a nonused position. Additionally, toilet trainers should have a urine deflector which can be easily positionable out of the way within the child's toilet seat when not in use so that the child can easily slide onto the child's toilet seat without the need of circumventing the upstanding urine deflector. The urine deflector should be movable between its use and nonuse positions without the need of adult handling.

Prior art toilet trainers fail to provide these desirable characteristics. Presently employed toilet trainers require significant unsanitary handling by the child and adult, restrict the normal usage of the commode by adults, and render the bathroom area unattractive and aesthetically displeasing as the child's toilet trainer is cast onto the floor or, in some cases, kept on the wall during its storage. Often, the toilet trainer is cast either into the bathtub or under the sink vanity when it is not being used, and hence it is not readily accessible when the child most needs it. Prior art toilet trainers are incapable of being easily connected to the conventional commode, but rather they require the use of special recessed lids and brackets, as well as special tools for assembly. Finally, prior art devices fail to provide a universally adaptable mechanism on a conventional toilet lid which allows the child's toilet seat to be automatically lifted from its use position to a storage position without either the need of touching the toilet seat or of using a specially designed lid.

U.S. Pat. No. 2,820,969 in the name of Louther Dewell Wedge discloses a specially adapted lid which fits onto a child's toilet seat so that the lid and child's toilet seat can be moved as one. However, this device lacks the universal adaptability required since the conventional lid of the typical commode must be replaced by a specially designed lid which can specifically accommodate the toilet seat of the device.

The need of such a specially designed lid to use with the child's toilet trainer is typical of prior art devices which fit the child's toilet seat into a specially recessed lid when the child's toilet seat is not being used. The adult or child lifts the child's toilet seat and positions it within the specially adapted lid. Examples of such a recessed lid configuration are demonstrated by the above patent to Wedge and U.S. Pat. No. 2,111,044 in the name of Vernon E. Crosby.

Other devices are positionable onto the commode just prior to each use. When not needed, the toilet trainer is removed from the commode and it is stored by either placing it on the bathroom floor or on the wall near the commode, or hiding it in a closet, bathtub or vanity cabinet. Of course, prior to reuse, the toilet trainer must be located and repositioned on the commode. This procedure of requiring the child to find the toilet trainer before he may use the commode creates confusion in the child's mind since he must follow a procedure distinguishable from that conventionally used by adults. Other toilet trainers are manufactured as completely separate units which have their own collection areas and they are not used in conjunction with the conventional commode. These devices require the adult to clean the collection area and hence, the use of such a toilet trainer necessitates unsanitary contact with the waste product of the child as well as being inconvenient and time consuming to use.

Prior art devices provide essentially three urine deflector options to the consumer. First, some types of deflectors or splashguards are made as one integral piece with the child's toilet seat and hence are always in a use position. U.S. Pat. No. 3,153,248 in the name of Hobart G. Miller is exemplary of this type. The child, however, has difficulty in sliding onto and off of the seat since the deflector presents an encumbrance. Secondly, some models of deflectors snap onto the toilet seat just prior to use. These devices, however, require the unsanitary handling of the deflector by later users of the commode who wish to remove the deflector. As with the detachable toilet seat, handling and storage problems arise when the deflector is disconnected from the toilet seat. Finally, some prior art urine deflectors are movable within the child's toilet seat and always automatically assume an upright position when the child's toilet seat is in place. Hence these deflectors require a person to hold the deflector down in the toilet seat if its use is not required. Examples of this type of urine deflector are shown in U.S. Pat. No. 2,494,813 in the name of Robert Hughes and U.S. Pat. No. 3,601,822 in the name of Sol Weiss.

DISCLOSURE OF THE INVENTION

The present system obviates these disadvantages inherent in the prior art toilet trainers by providing a universally adaptable toilet seat which is sanitary, easy to use and non-restrictive of the normal use of the commode. The present invention provides a universal child's toilet trainer which incorporates a pick-up mechanism capable of being attached the conventional toilet, for example, to the toilet lid for automatically lifting the child's toilet seat from an operative to an inoperative position without the need for human contact with the child's toilet seat. the conventional toilet seat can be circular, oblong or U-shaped as is well known. The conventional lid is generally without relieved areas. The urine deflector of the toilet trainer of the present invention is permanently attached to the front portion of the child's toilet seat and it is capable of being retracted into a recess in the child's toilet seat when it is not needed.

In a preferred embodiment, the universal child's toilet trainer of the present invention is usable with a conventional toilet seat and lid. The toilet including a trainer has an auxiliary toilet seat which can be oval, oblong or U-shaped with a central aperture of a smaller diameter than the diameter of the conventional toilet seat. The auxiliary toilet seat, in an operational position, rests upon the conventional toilet seat and, in Means for attaching the auxiliary toilet seat to the conventional toilet are provided to allow movement of the auxiliary toilet seat between the storage and operational positions. The attachment means can comprise, for example, a hinge or hinges with one or more arms associated with each hinge; or a flexible hinge type material such as a plastic or rubber member, rope, synthetic or natural fabric (for example nylon or cotton) cable, or the like. Preferably, the attachment means will be made of polypropylene which can form one or more "living hinges". The preferred attachment means is fastened to the conventional lid and includes at least two hinges for every arm. This permits both the conventional lid and the auxiliary seat to move independently of one another, which cannot occur if only one hinge is employed because the conventional lid and the auxiliary seat rotate around different axes.

When polypropylene is employed to fabricate the attachment means, it can also be employed to fabricate the auxiliary seat. Accordingly, the attachment means, including the arms with the "living hinges" and the auxiliary seat can be an integrally molded unit, and if a hook latch is employed to raise the auxiliary seat, it too can be integrally molded with the attachment means, etc. Because "living hinges" are merely a thin membrane of plastic, such as polypropylene, they permit some lateral movement. If the two arms are separately formed from the remainder of the attachment means and are fastened and unfastened by lateral movement, i.e., by spreading the arms apart, the living hinge permits the removal of the auxiliary seat and the arms from the remainder of the attachment means. The toilet trainer includes means on the conventional toilet or attaching means for picking up the auxiliary toilet seat from the operational position in which the auxiliary toilet seat rests upon the conventional toilet seat so as to fix the auxiliary toilet seat in the storage position flat against the lid. The pick-up means is activated upon closure of the conventional lid. A urine deflector may be provided on the toilet trainer comprising a recess in the front portion of the auxiliary toilet seat and a splashguard movable within the recess between a use position and a nonuse position. In the use position, the splashguard extends above the plane of the auxiliary toilet seat and in the nonuse position, the splashguard lies within the recess of the auxiliary toilet seat so as to conform to its contour.

In an alternative embodiment, the auxiliary toilet seat has means for connecting the auxiliary toilet seat to the means which join the conventional toilet seat to the commode. A protrusion on the underside of the conventional lid picks up the auxiliary toilet seat from the operational position and moves it to the storage position. The auxiliary toilet seat, the conventional toilet seat and the connection means can be made as one integral unit. Further details of the present invention will become apparent from a study on the following specifications, drawings and claims.

DETAILED DESCRIPTION OF THE INVENTION

Figure 1:
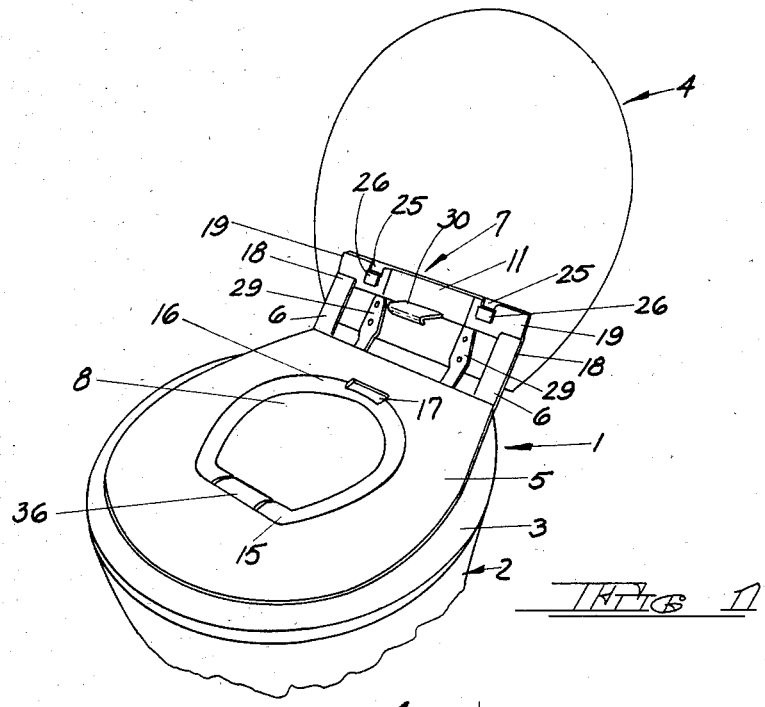
FIG. 1 is a front prospective view of the universal child's toilet trainer attached to a conventional toilet seat and lid.
Figure 2:
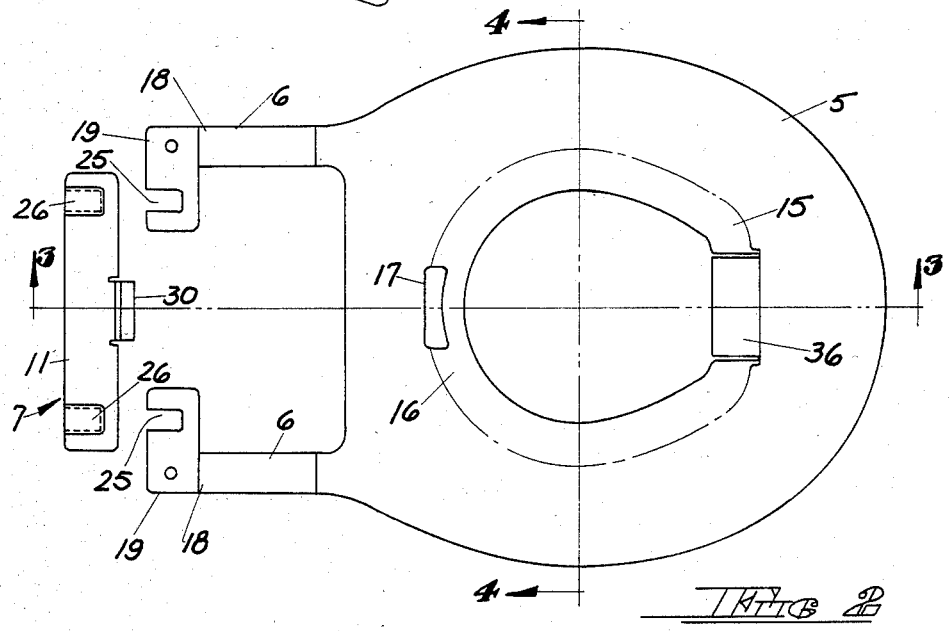
FIG. 2 is a top plan view of the child's toilet trainer.

Referring now to FIGS. 1 and 2, the universal child's toilet trainer 1 of the present invention is shown in use with a conventional commode 2 having a conventional toilet seat 3 and a lid 4. The toilet trainer 1 includes an auxiliary toilet seat 5, a pair of extension arms 6 and a pick-up unit 7.

The auxiliary toilet seat 5 can be made of plastic or wood with blow molded plastic being preferred. The auxiliary seat 5 has a central aperture 8, the diameter of which is smaller than the diameter of the central aperture 9 in the conventional toilet seat 3 customarily used by adults. The smaller dimensions are required for the auxiliary toilet seat 5 since infant and child users require a support which readily conforms to their relatively smaller body sizes to prevent the child from slipping or falling during use of the toilet trainer 1. The auxiliary toilet seat 5 generally has leg crevices (not shown) which prevent the child's legs from dangling to the sides of the commode 2 during use. Conventionally used rubber cushions (not shown) can be placed on the underside of the auxiliary toilet seat 5 to eliminate slippage of the auxiliary toilet seat 5 from the commode 2. Additionally, the cushions protect the commode 2 from being marred by the placing of the auxiliary toilet seat 5 upon it. Generally, the contour of the auxiliary toilet seat 5 slopes inwardly toward the central aperture 8. The underside 10 of the auxiliary toilet seat can be either flat or tapered. A tapered underside 10 avoids hindering the usage of the commode 2 when the auxiliary toilet seat 5 is in the storage position. The central aperture 8 of the auxiliary toilet seat 5 is positioned directly over the central aperture 9 of the conventional toilet seat so that the regular commode 2 can be used to dispose of the child's waste.

Figure 3:
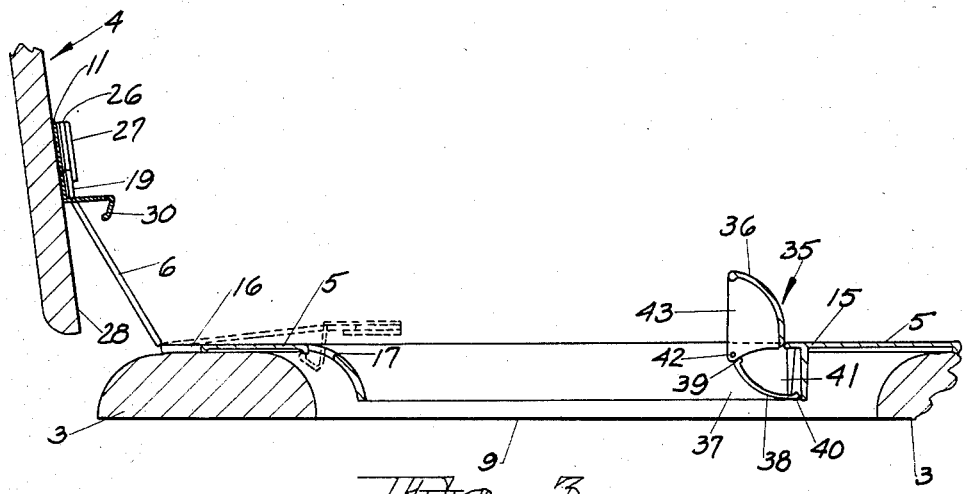
FIG. 3 is a cross sectional view of the child's toilet trainer taken along line 3—3 in FIG. 2 with the auxiliary toilet seat being in an operational position.
Figures 8, 9:
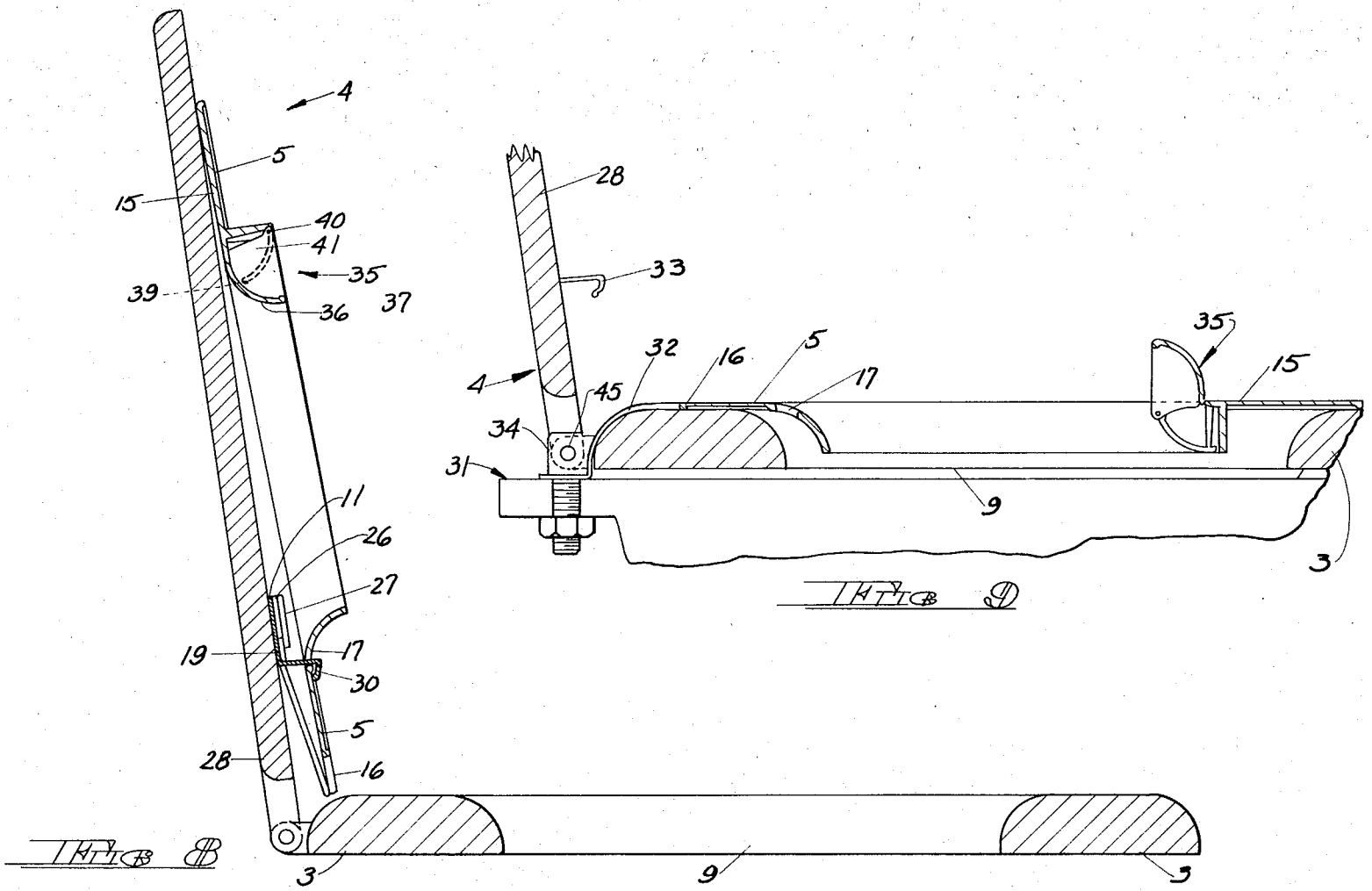
FIG. 8 is a cross sectional view of the child's toilet trainer taken along the same line as FIG. 3 with the auxiliary toilet seat being in a storage position.
FIG. 9 is a side cross sectional view of an alternative embodiment of the child's toilet trainer.

In an operational position as shown in FIG. 3, the auxiliary toilet seat 5 rests horizontally upon the conventional toilet seat 3. In a storage position, as shown in FIG. 8, the auxiliary toilet seat 5 lies flat against the lid 4 of the commode 2 and thereby it is out of the way if an adult or child wishes to use the commode 2 without the auxiliary toilet seat 5. The auxiliary toilet seat 5 rests in a storage position without altering the workings of the conventional toilet seat 3 or lid 4. The lid 4 need not be altered or recessed to receive the auxiliary toilet seat 5, but rather the conventional lid found on any commode can be used with the toilet trainer 1 even when the auxiliary toilet seat 5 lies upright against the lid 4 in a storage position.

The auxiliary toilet seat 5 has a front portion 15 and a rear portion 16. The rear portion 16 has an opening 17 centrally located along the rear of the central aperture 8 of the auxiliary toilet seat 5. In the preferred embodiment, the opening 17 is positioned within the body of the rear portion 16 so that on all four sides the opening 17 is bound by the auxiliary toilet seat 5. However, the opening 17 can also be positioned so as to be a cut-out which is bound on three sides by the auxiliary toilet seat 5 and on the fourth side by the central aperture 8 of the auxiliary toilet seat 5.

A pair of extension arms 6 connects the rear portion 16 of the auxiliary toilet seat 5 to the pick-up unit 7 on the lid 4 to allow movement of the auxiliary toilet seat 5 between the storage and operational positions. The extension arms 6 are elongated pieces of material, preferably plastic, which can be either separately attached to the auxiliary toilet seat 5 after the manufacture of the auxiliary toilet seat 5 or manufactured as one integral unit with the auxiliary toilet seat 5. The latter alternative is preferred when both the auxiliary toilet seat 5 and the extension arms 6 are being made from molded plastic.

The outer end 18 of each extension arm 6 has a mounting pad 19. The mounting pad 19 can be made of molded plastic, sturdy cardboard, plexiglass or a number of other rigid materials. If the mounting pad 19 is made of molded plastic, then it can be made as one integral unit along with the extension arms 6 and the auxiliary toilet seat 5. If the mounting pad 19 is made from a different material than that of the remainder of the toilet trainer 1, then it can be attached to the outer end 18 by conventional means.

Figure 6:
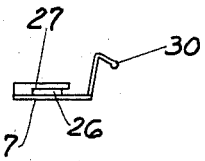
FIG. 6 is a partial side cross sectional view of the strip and L-hook of the child's toilet trainer.
Figure 7:
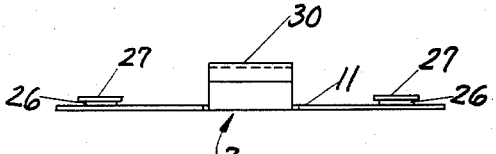
FIG. 7 is a partial front cross sectional view of the strip and L-shaped hook of the child's toilet trainer.

The pick-up unit 7 includes a strip 11 having a pair of projections 26 and a hook 30. The hook 30 can be L-shaped. Each mounting pad 19 has a cut-out 25 of a shape and a size which allows each cut-out 25 to grip tightly a projection 26 on the strip 11. Preferably, both the cut-out 25 and the projection 26 are of the same square dimensions so that the cut-out 25 fits snugly onto the projection 26 to prevent the slippage of the extension arms 6 and hence the auxiliary toilet seat 5 from the lid 4. Alternatively, the cut-out 25 and projections 26 can be circular in shape. The projections 26 are raised knobs, preferably made of molded plastic, which are strong enough to support the mounting pads 19 pulling thereon as the auxiliary toilet seat 5 is moved in various positions. As shown in FIGS. 6 and 7, each projection has a cap 27 with a larger diameter than the remainder of the projections 26 so that when the cut-out 25 fits around the projections 26, the cap 27 holds the mounting pad 19 in place against the strip 11.

Figure 4:
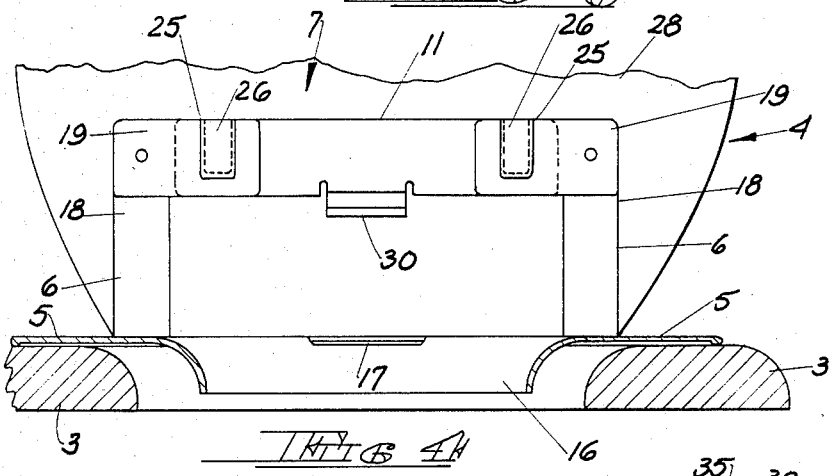
FIG. 4 is a fragmentary cross sectional view of the child's toilet trainer taken along line 4—4 in FIG. 2.

The strip 11 is secured to the underside 28 of the lid 4 just above the brackets 29 which connect the lid 4 to the commode 2. The strip 11 needs only to be sufficiently wide so as to hold the strip 11 to the lid 4. At opposite ends of the strip 11, as shown in FIG. 4, the projections 26 extend perpendicularly outward relative to the underside 28 of the lid 4 and, as previously noted, they receive the mounting pads 19. The strip 11 can be made from plastic, rigid cardboard or any other strong durable substance. Preferably, the projections 26 are made as one integral unit with the strip 11. The backside of the strip 11 has an adhesive backing which allows the strip 11 to be bound to the lid 4, or alternatively, the strip 11 can be attached to the lid by numerous other conventional techniques.

As shown in FIG. 3, the L-shaped hook 30 is positioned on the strip 11 so that the hook 30 engages the opening 17 on the rear portion 16 of the auxiliary toilet seat 5 as lid 4 is closed down upon the auxiliary toilet seat 5. As the lid 4 lies horizontally upon the auxiliary toilet seat 5, the hook 30 grasps the opening 17 and thereby lifts the auxiliary toilet seat 5 up from the conventional toilet seat 3 as the lid 4 is pulled up and repositioned perpendicular to the conventional toilet seat 3. The hook 30 automatically, without need of a person directly touching the auxiliary toilet seat 5, moves the auxiliary toilet seat 5 between the operational position in which it lies horizontally on top of the conventional toilet seat 2 and the storage position in which the auxiliary toilet seat 5 rests upright against the lid 4 as shown in FIG. 8. When a child later wishes to use the auxiliary toilet seat 5, he merely taps the side of the auxiliary seat 5, and the auxiliary toilet seat 5 pops off the hook 30 and falls onto the conventional toilet seat 3 where it again assumes the operational position.

Preferably, the hook 30 is one integral unit with the strip 11, especially if the hook 30 and strip 11 are made of molded plastic. Alternatively, the hook 30 can be a separate piece which is attached to the strip 11 by an adhesive, screws or other conventional means. The hook 30 should be of sufficient length and width to have the requisite strength and durability to lift the auxiliary toilet seat 5 as the lid 4 is raised from the commode 2. Alternatively, the auxiliary toilet seat 5 can be picked up by a protrusion or hook 30 which is directly molded onto the lid 4 and which fits into the opening 17 on the auxiliary toilet seat 5.

In an alternative embodiment, as shown in FIG. 9, the auxiliary toilet seat 5 is attached to the hinge brackets 31 of the commode 2 by connection arms 32 instead of attaching the auxiliary toilet seat 5 to the underside 28 of the lid 4 as shown in FIGS. 1 and 3. The hinge brackets 31, including a knob 34 and a hinge pin 45, are customarily used to join the conventional toilet seat 3 to the commode 2. The connection arms 32 join the rear portion 16 of the auxiliary toilet seat 5 to the hinge brackets 31 of the commode 2. The connection arms 32 are constructed similar to the extension arms 6. The connection arms 32 are mounted or attached to the hinge brackets 31 by sliding the connection arms 32 around the knob 34 of the hinge brackets 31. A protrusion 33 is located on the underside 28 of the lid 4 at a point which allows the protrusion 33 to engage the opening 17 in the rear portion 16 of the auxiliary toilet seat 5 when the lid is closed down upon the auxiliary toilet seat 5. The protrusion 33 can either be premolded as one integral unit with the lid 4 or be separately attached to the lid by glue, adhesive, screws or other similar techniques. Similarly, the conventional toilet seat 3, the auxiliary toilet seat 5, and the connection arms 32 can be manufactured as one unit.

Figure 5:
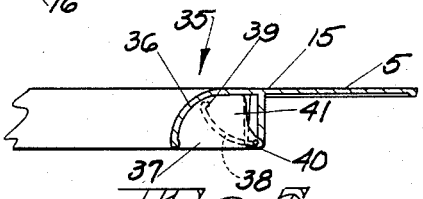
FIG. 5 is a cross sectional view of the front portion of the child's toilet trainer showing the urine deflector being in a nonuse position.

As shown in FIGS. 3 and 5, a urine deflector unit 35 is located at the front portion 15 of the auxiliary toilet seat 5 to aid male users of the toilet trainer 1. The urine deflector unit 35 includes a splashguard 36 which lies within a recess 37 in the front portion 15 of the auxiliary toilet seat 5. A curved slot 38 with upper knothold 39 and lower knothole 40 is located on the sidewalls 41 of the recess 37. A guidepin 42, capable of fitting into the slot 38, is located on each of the longitudinal sides 43 of the splashguard 36. The splashguard 36 is movable between a nonuse position in which the splashguard 36 is located within recess 37, as shown in FIG. 5, and a use position in which the splashguard extends above the plane of the auxiliary toilet seat 5, as shown in FIG. 3.

To move the splashguard 36 between the two positions, the child, once he is on the auxiliary toilet seat 5, merely grasps the splashguard 36 and places it in the desired position. The guidepins 42 slide within the slots 38 to move the splashguard 36. In the use position, the guidepins 42 are in the upper knothole 39 and in the nonuse position, the guidepins 48 lock within the lower knothole 40 so that the splashguard 36 can blend into the contour and shape of the auxiliary toilet seat 5. Preferably, the splashguard 36 and guidepins 42 are made from molded plastic.

After a child uses the splashguard 36, he can manually replace it into the recess 37. If he should forget to do so, a subsequent adult user of the commode 2 can put the splashguard 36 into the recess 37 by merely closing the lid 4 down onto the auxiliary toilet seat 5 and then lifting the lid 4 so as to position the auxiliary toilet seat 5 in the storage position. There is no need for the adult to touch the splashguard 36. The urine deflector 35 can be used with an auxiliary toilet seat 5 which does not have an opening 17 and a pick-up unit 7 on the lid to move the auxiliary toilet seat 5 between the operational and storage positions. Rather, the urine deflector 35 can also be used with an auxiliary toilet seat 5 which is merely positioned on the conventional toilet seat and which is not attached to the lid 4.

What is claimed is:

1. A universal child's toilet trainer usable with a conventional toilet seat and lid said lid having an inner planar surface without relieved areas comprising:

(a) an auxiliary toilet seat having a central aperture, the central aperture being of a smaller diameter than that of a conventional toilet seat, the auxiliary toilet seat in an operational position resting upon the conventional toilet seat, and in a storage position, lying flat against said inner planar surface of said lid;

(b) means for attaching the auxiliary toilet seat to the lid to allow movement of the auxiliary toilet seat between the storage and operational positions; and (c) means on the attaching means for picking up the auxiliary toilet seat from the operational position in which the auxiliary toilet seat rests upon the conventional toilet seat and fixing the auxiliary toilet seat in the storage position adjacent said inner planar surface of said lid whereby the use of the child's toilet trainer does not interfere with the adult use and operation of the conventional toilet seat.

2. A universal child's toilet trainer as described in claim 1, wherein the auxiliary toilet seat, the attaching means, and pick-up means are one integral unit.

3. A universal child's toilet trainer as described in claim 1, wherein the attaching means comprises:

(a) a pair of extension arms extending from the rear portion of the auxiliary toilet seat; and (b) a strip connecting the outer ends of both extension arms the strip being positionable on the conventional toilet lid.

4. A universal child's toilet trainer as described in claim 3, wherein the pick-up means comprises a hook positioned on the strip so that the hook engages the opening on the rear portion of the auxiliary toilet seat when the lid lies horizontally upon the auxiliary toilet seat, the hook being capable of grasping the opening of the auxiliary toilet seat as the lid is raised.

5. A universal child's toilet trainer usable with a conventional toilet including a seat and lid, said lid having an inner planar surface without relieved areas comprising:

(a) an auxiliary toilet seat having an aperture of significantly smaller size than that of a conventional toilet seat, the auxiliary toilet seat in an operational position resting upon the conventional toilet seat, and in a storage position, lying flat against said inner planar surface of said lid;

(b) means for attaching the auxiliary toilet seat to the conventional toilet to allow movement of the auxiliary toilet seat between the storage and operational positions; and (c) means attached to the conventional toilet or to the attaching means for picking up the auxiliary toilet seat from the operational position in which the auxiliary toilet seat rests upon the conventional toilet seat and placing the auxiliary toilet seat in the storage position adjacent said inner planar surface of said lid whereby the use of the child's toilet trainer does not interfere with the adult use and operation of the conventional toilet.

6. The universal child's toilet seat of claim 5, wherein the means for attaching the auxiliary toilet seat can be a combination of arms and hinges, or a flexible material.

7. The universal child's toilet seat of claim 6, wherein the flexible material can be rope, cable or rubber member.

8. The universal child's toilet seat of claim 5, wherein the pick-up means can be anyone of velcro strips, or one or more magnets with or without a ferrous strip.

9. A universal child's toilet trainer usable with a conventional toilet seat and lid comprising:

(a) an auxiliary toilet seat having a central aperture, the central aperture being of a smaller diameter than that of a conventional toilet seat, the auxiliary toilet seat being made of molded plastic, the auxiliary toilet seat in an operational position resting upon the conventional toilet seat, and in a storage position lying flat against the lid, the rear portion of the auxiliary toilet seat having an opening;

(b) a strip having an adhesive side, the strip attached to the lid by securing the adhesive side of the strip to the underside of the lid;

(c) a pair of square projections extending perpendicularly from the strip;

(d) a pair of extension arms connecting the rear portion of the auxiliary toilet seat to the strip on the underside of the lid, the extension arms allowing the auxiliary toilet seat to move between the operational position and the storage position, an outer end of each extension strip having a square cut-out corresponding in size to the square projections on the strip, the cut-out fitting onto the projections;

(e) a hook mounted on the strip, the hook being positioned on the strip so that it engages the opening in the auxiliary toilet seat when the lid lies horizontally upon the auxiliary toilet seat, the hook grasping the opening of the auxiliary toilet seat as the lid is raised thereby lifting the auxiliary toilet seat from the operational position to the storage position;

(f) the front portion of the auxiliary toilet seat having a recess, the recess having side walls with a curved slot; and (g) a splashguard with longitudinal sides being movable within the recess, the longitudinal sides having guidepins co-acting with the slots on the side walls of the recess, in a use position the splashguard lifts out of the recess to extend above the plane of the auxiliary toilet seat, in a nonuse position the splashguard lies within the recess so as to conform to the contours of the auxiliary toilet seat.

10. A universal child's toilet trainer usable with a conventional toilet seat and lid comprising:

(a) an auxiliary toilet seat having a central aperture, the central aperture being of a smaller diameter than that of a conventional toilet seat, the auxiliary toilet seat in an operational position resting upon a conventional toilet seat, and in a storage position, lying flat against the lid;

(b) a strip secured to the underside of the lid, the strip having a pair of projections extending perpendicularly from the underside of the lid;

(c) a pair of extension arms connecting the rear portion of the auxiliary toilet seat to the strip on the underside of the lid;

(d) a mounting pad on the outer end of each extension arm, each mounting pad having a cut-out, the cut-out fitting onto the pair of projections on the strip;

(e) a hook positioned on the strip so that the hook engages the open arm on the rear portion of the auxiliary toilet seat when the lid lies horizontally upon the auxiliary toilet seat, the hook being capable of grasping the opening of the auxiliary toilet seat as the lid is raised, whereby the use of the child's toilet trainer by the child does not interfere with the adult use and operation of the conventional toilet seat.

11. A universal child's toilet trainer as described in claim 10, wherein the side of the strip secured to the underside of the lid has an adhesive backing to bond the strip to the lid.

12. A universal child's toilet trainer as described in claim 10, wherein both the projections of the strip and the cut-outs of the mounting pads are of the same dimensions to prevent the slippage of the extension arms from the lid.

13. A universal child's toilet trainer as described in claim 10, wherein the extension arms, the projections on the strip, the strip, the hook and the auxiliary toilet seat are composed of a molded plastic.

* * * * *